US010383206B1

(12) United States Patent
Nuttens et al.

(10) Patent No.: US 10,383,206 B1
(45) Date of Patent: Aug. 13, 2019

(54) SUPERCONDUCTOR CYCLOTRON REGENERATOR

(71) Applicant: Ion Beam Applications S.A., Louvain-la-Neuve (BE)

(72) Inventors: Vincent Nuttens, Louvain-la-Neuve (BE); Jarno Van De Walle, Louvain-la-Neuve (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 16/213,886

(22) Filed: Dec. 7, 2018

(30) Foreign Application Priority Data

Dec. 11, 2017 (EP) ..... 17206339

(51) Int. Cl.
*H05H 13/00* (2006.01)
*H05H 7/00* (2006.01)
*H05H 7/04* (2006.01)

(52) U.S. Cl.
CPC ..... *H05H 13/005* (2013.01); *H05H 7/00* (2013.01); *H05H 7/04* (2013.01); *H05H 13/00* (2013.01)

(58) Field of Classification Search
CPC ..... H05H 13/00; H05H 13/02; H05H 13/005; H05H 7/04; H05H 7/10; H05H 7/20
See application file for complete search history.

(56) References Cited

U.S. PATENT DOCUMENTS 8,791,656 B1 * 7/2014 Zwart ..... H05H 7/04 315/503
2007/0171015 A1 * 7/2007 Antaya ..... H05H 7/04 335/216

(Continued)

FOREIGN PATENT DOCUMENTS

JP 2015-79626 A 4/2015
WO WO-2007/130164 A2 11/2007
WO WO-2013/098089 A1 7/2013

OTHER PUBLICATIONS

W. Kleeven et al. (Mar. 2014) "The IBA Superconducting Synchrocyclotron project S2C2," *Proceedings of Cyclotron 2013*, ISBN: 978-3-95450-128-1.

(Continued)

*Primary Examiner* — Thai Pham
(74) *Attorney, Agent, or Firm* — Finnegan, Henderson, Farabow, Garrett & Dunner LLP

(57) ABSTRACT

A cyclotron for accelerating charged particles includes: a first and second superconducting main coils arranged parallel to one another on either side of a median plane; and at least a first and second field bump modules arranged on either side of the median plane, and extending circumferentially over a common azimuthal angle for creating a local magnetic field bump in the main magnetic field. Each of the field bump modules includes at least one superconducting bump coil locally generating a broad magnetic field bump having a bell-shape defined by a first gradient of the z-component in a radial direction, r. Each of the field bump (Continued)

modules further includes at least one superconducting bump shaping unit positioned such as to locally steepen the first gradient produced by the at least one superconducting bump coil, when said at least one superconducting bump shaping unit is activated.

17 Claims, 6 Drawing Sheets

(56) References Cited

U.S. PATENT DOCUMENTS

| | | | | |
|---|---|---|---|---|
| 2013/0141019 | A1* | 6/2013 | Kleeven | H05H 7/04 315/502 |
| 2013/0249443 | A1* | 9/2013 | Antaya | H05H 7/10 315/502 |
| 2014/0042934 | A1 | 2/2014 | Tsutsui | |
| 2017/0231081 | A1 | 8/2017 | Gall et al. | |

OTHER PUBLICATIONS

Extended European Search Report issued in corresponding European Patent Application 17206339.8 dated May 24, 2018.

* cited by examiner

SUPERCONDUCTOR CYCLOTRON REGENERATOR

CROSS-REFERENCE TO RELATED PATENT APPLICATIONS

This application claims foreign priority of European Patent Application No. 17206339.8, filed Dec. 11, 2017, which is hereby incorporated by reference in its entirety.

TECHNICAL FIELD

The present disclosure concerns extraction of a beam of accelerated charged particles out of a cyclotron. In particular, it concerns a so-called "regenerative" beam extraction system based on the generation of a local perturbation of the main magnetic field to steer the last accelerated orbit towards the extraction channel of the accelerator. The perturbation, also referred to as a bump or dip, is created by superconducting elements including superconducting coils. This has inter alia the advantage of ensuring an independently controllable response of the magnetic field bump with respect to variations of the drive current in the main coils.

BACKGROUND

A cyclotron is a type of circular particle accelerator in which negatively or positively charged particles accelerate outwards from the centre of the cyclotron along a spiral path up to energies of several MeV. There are various types of cyclotrons. In isochronous cyclotrons, the particle beam runs each successive cycle or cycle fraction of the spiral path in the same time. A synchrocyclotron is a special type of cyclotron, in which the frequency of the driving RF electric field varies to compensate for relativistic effects as the particles' velocity approaches the speed of light. This is in contrast to the isochronous cyclotrons, where this frequency is constant. Cyclotrons are used in various fields, for example in nuclear physics, in medical treatment such as proton-therapy, or in radio pharmacology.

A cyclotron comprises several elements including an injection system, a radiofrequency (RF) accelerating system for accelerating the charged particles, a magnetic system for guiding the accelerated particles along a precise path, an extraction system for collecting the thus accelerated particles, and a vacuum system for creating and maintaining a vacuum in the cyclotron. Superconducting cyclotrons require a cryocooling system for maintaining the superconducting elements thereof at their superconducting temperatures.

An injection system introduces a particle beam with a relatively low initial velocity into an acceleration gap at or near the centre of the cyclotron. The RF accelerating system sequentially and repetitively accelerates this particle beam, guided outwards along a spiral path within the acceleration gap by a magnetic field generated by the magnetic system.

The magnetic system generates a magnetic field that guides and focuses the beam of charged particles along the spiral path until reaching its target energy, Ei. The magnetic field is generated in the gap defined between two field shaping units by two solenoid main coils wound around these field shaping units, which can be magnet poles or superconducting coils separated from one another by the acceleration gap.

The main coils are enclosed within a flux return, which restricts the magnetic field within the cyclotron. Vacuum is extracted at least within the acceleration gap. Any one of the field shaping units and flux return can be made of magnetic materials, such as iron or low carbon steel, or can consist of coils activated by electrical energy. The coils, as well as the main coils can be made of superconducting materials. In this case, the superconducting coils are cooled below their critical temperature. Cryocoolers can be used to cool the superconducting components of a cyclotron below their critical temperature which can be of the order of between 2 and 10 K, typically around 4 K for low temperature superconductors (LTS) and of the order of between 20 and 75 K for high temperature superconductors (HTS).

When the particle beam reaches its target energy, the extraction system extracts it from the cyclotron at a point of extraction and guides it towards an extraction channel (cf. FIG. 2). Several extraction systems exist and are known to a person of ordinary skill in the art.

In the present disclosure the extraction system creates oscillations of the particles with respect to the equilibrium orbit to drive the particles out of the cyclotron. A so-called "regenerative" beam extraction system steers the last accelerated orbit towards the extraction channel of the accelerator by locally generating a perturbation of the main magnetic field. A magnetic field bump of magnitude $\Delta Bz$, can be created over an azimuthal interval, $\varphi b$, inducing a radial oscillation responsible for a shift, $\Delta y$, of the centre of the orbit. For a first harmonic field perturbation the magnitude of the shift is proportional to the amplitude of the first harmonic field perturbation. As illustrated in FIG. 2, the orbit center is shifted in the direction of the perturbation by a distance $\Delta y$. The shift eventually leads the particles out of the cyclotron through the extraction channel (cf. FIG. 2).

Iron bars with a well-defined azimuthal and radial extension (called "regenerator") are often used to generate a magnetic field bump. For example, U.S. Pat. No. 8,581,525 and WO2013098089 describe iron based regenerators. An iron generated field bump can have a maximal magnetic field gradient, dBz/dr, in the radial direction of the order of up to about 80 T/m. One drawback with iron based regenerators includes that the magnitude of the magnetic field bump cannot be varied easily, and certainly not during operation of the cyclotron. This is a drawback when a same cyclotron is used to extract particles at different energies.

Like magnet poles, iron based regenerators can be replaced by coils, in particular by superconducting coils which can generate higher magnetic fields. The use of coils allows the magnitude, $\Delta Bz$, of the field bump to be varied independently of the magnitude of the main magnetic field, Bz. As shown in FIG. 1(*b*), however, a magnetic field bump generated by superconducting bump coils is substantially broader than a field bump produced by an iron based regenerator and the resulting maximal magnetic field gradient of the order of 20 T/m is too low to create an optimal perturbation. Without wishing to be bound by any theory, this can at least partly be explained as follows. Superconducting bump coils are cooled to very low temperatures, below their critical temperature (for example temperatures close to liquid helium, for low temperature superconductors) and maintained in a vacuum. The superconducting bump coils are therefore encapsulated inside a cooled radiation shield, which is itself contained within a vacuum chamber. This nested structure requires space and moves the superconducting bump coils further away in the z-direction from the accelerator median plane, P, which increases the full width half max (FWHM) of the coil-based regenerator field bump.

There therefore remains a need for superconducting regenerators allowing the linear variation of the magnitude, ΔBz, of the magnetic field bump with the main magnetic field, Bz, and at the same time generating an optimal perturbation for extracting a charged particle beam out of a cyclotron. The present disclosure proposes a cyclotron provided with a superconducting regenerator fulfilling the foregoing requirements. The following sections describe these and other advantages in more details.

SUMMARY

The present disclosure concerns a cyclotron for accelerating charged particles, comprising:

at least a first superconducting main coil and second superconducting main coil centered on a common central axis, z, arranged parallel to one another on either side of a median plane, P, normal to the central axis, z, and defining a symmetry plane of the cyclotron, said at least first and second superconducting main coils generating a main magnetic field, B, when activated by a source of electric power;

a first field shaping unit and second field shaping unit arranged within the first and second superconducting main coils on either side of the median plane, P, and separated from one another by an acceleration gap, said first and second field shaping units being suitable for controlling in the acceleration gap a z-component, Bz, of the main magnetic field, which is parallel to the central axis, z;

at least a first field bump module and second field bump module arranged on either side of the median plane, P, and extending circumferentially over a common azimuthal angle, φb, for creating, when activated, a local magnetic field bump in the z-component, Bz, of the main magnetic field, wherein each of the field bump modules comprises:

at least one superconducting bump coil locally generating a broad magnetic field bump or dip when activated by a source of electric power, said magnetic field bump having a bell-shape of maximum bump magnitude, ΔBz, and being defined by a first gradient, $(dBz/dr)_1$, of the z-component, Bz, in a radial direction, r; and at least one superconducting bump shaping unit positioned such as to locally steepen the first gradient, $(dBz/dr)_1$, produced by the at least one superconducting bump coil, when said at least one superconducting bump shaping unit is activated.

BRIEF DESCRIPTION OF THE FIGURES

For a fuller understanding of the nature of the present disclosure, reference is made to the following detailed description taken in conjunction with the accompanying drawings in which:

FIG. 1(*b*) shows a blown-up representation of the magnetic field bump as obtained with a superconducting bump coil only (not according to the disclosure). FIGS. 1(*c*) and 1(*d*) show plots according to a first and second embodiments of the present disclosure. The bumps illustrated in FIG. 1(*b*)-1(*d*) are corrected by subtraction of the base line corresponding to the z-component, Bz, measured without the bump.

DETAILED DESCRIPTION

Figure 1A:
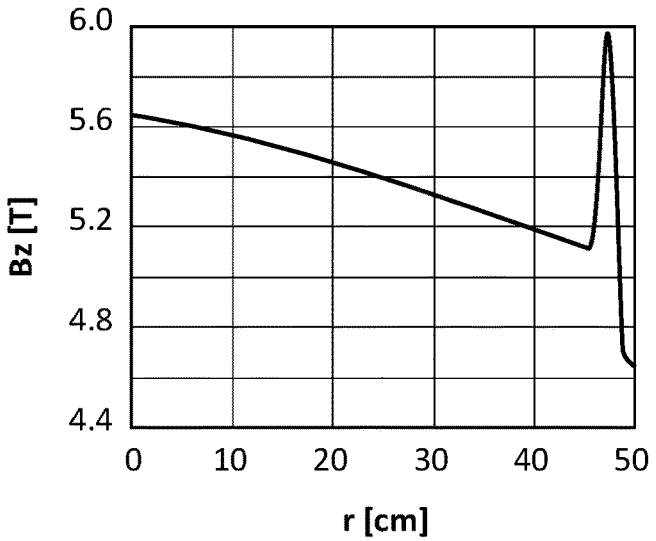
FIGS. 1(*a*)-1(*d*) show examples of magnetic field bumps plotted as a function of the radial position, in which FIG. 1(*a*) shows a plot over the whole radial distance of the field shaping units.
Figure 1B:
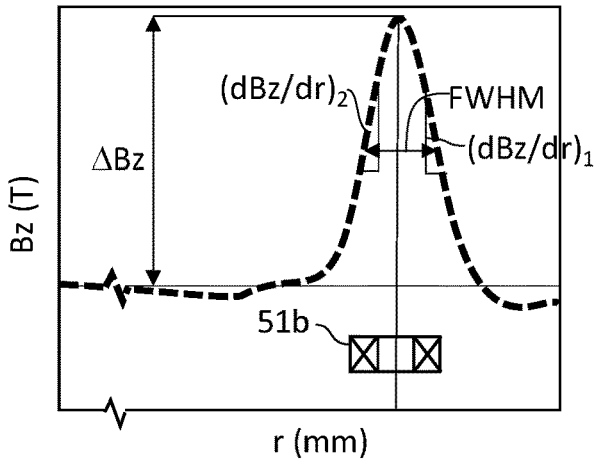
Figure 1C:
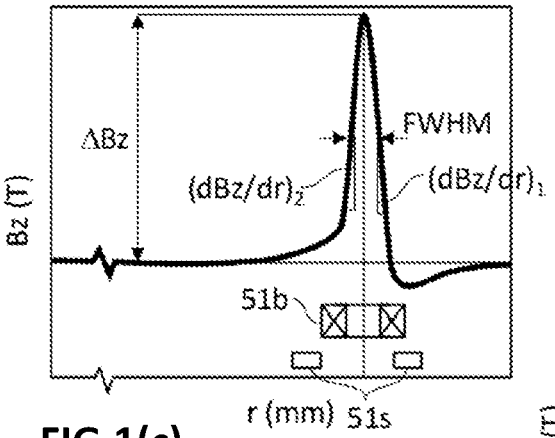
Figure 1D:
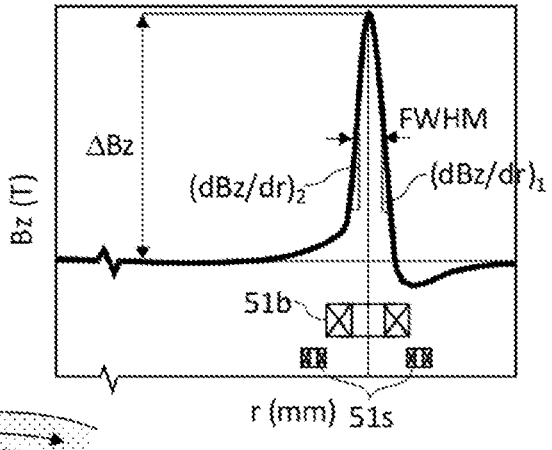
Figure 2:
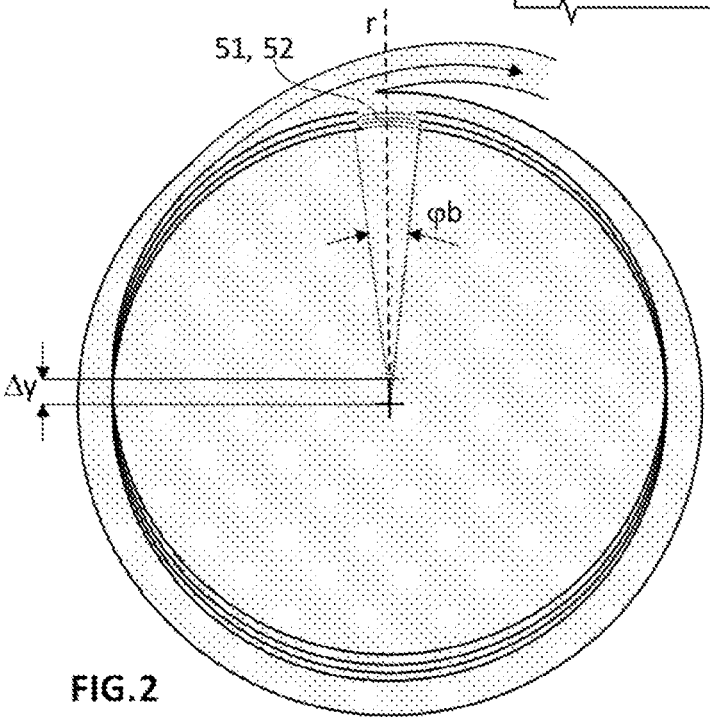
FIG. 2 shows a principle of regenerative extraction of a beam of accelerated particles.
Figure 3A:
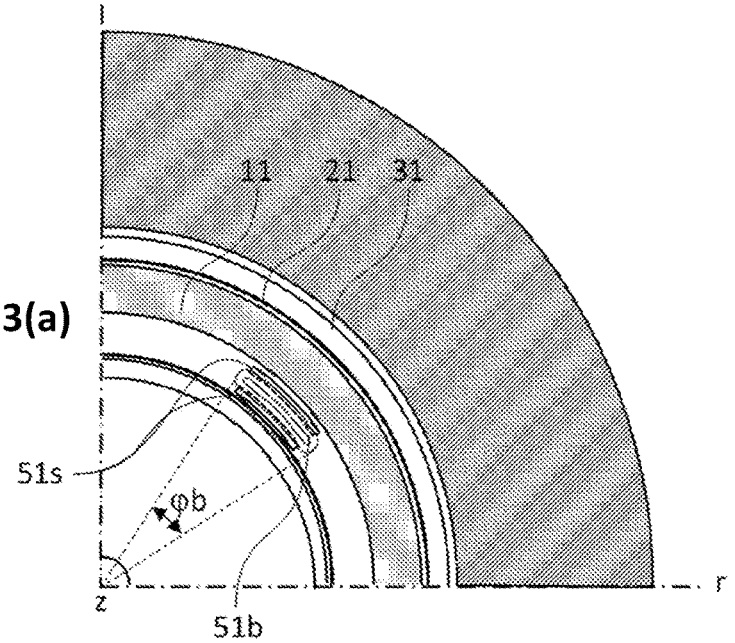
FIGS. 3(*a*) and 3(*b*) show a top view and a side cut view, respectively, of an embodiment of a cyclotron according to the present disclosure with magnet poles.
Figure 3B:
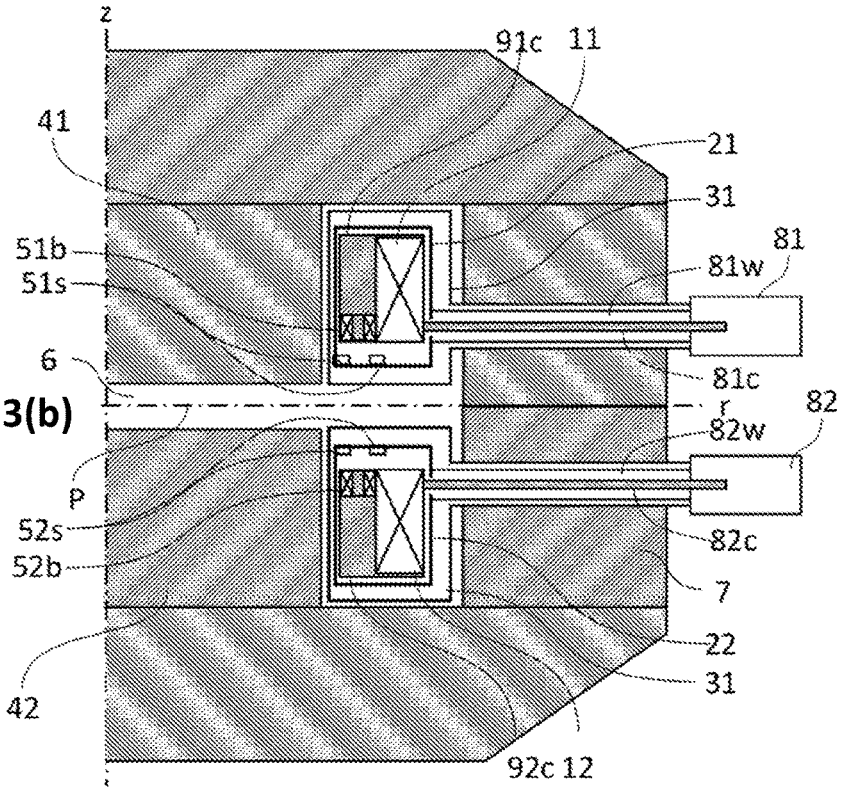
Figure 4A:
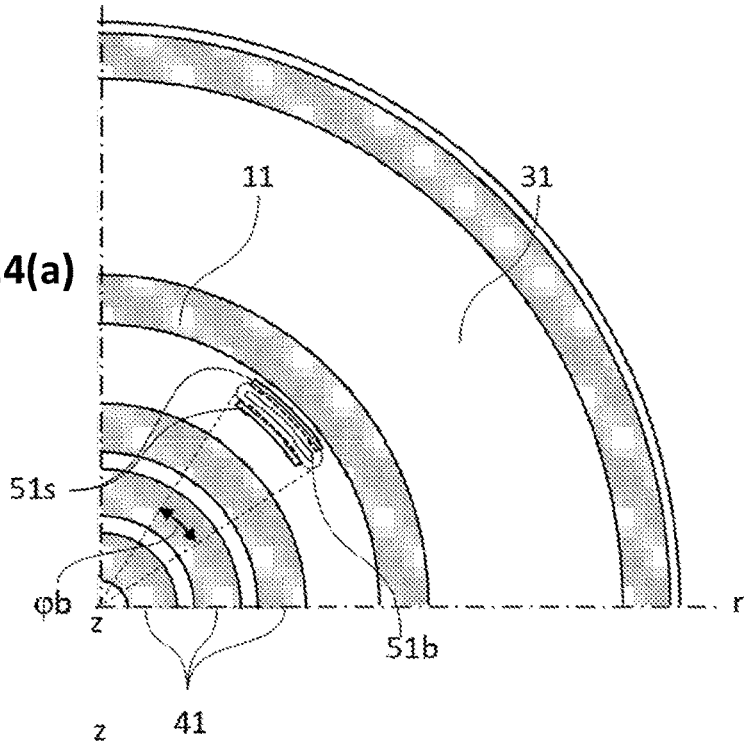
FIGS. 4(*a*)-4(*d*) show embodiments of a cyclotron according to the present disclosure with superconducting coils as field shaping units and as flux return, including a top view (FIG. 4(*a*)), a side cut view of a first embodiment (FIG. 4(*b*)), a side cut view of a second embodiment (FIG. 4(*c*)), and a side cut view of a third embodiment (FIG. 4(*d*)).
Figure 4B:
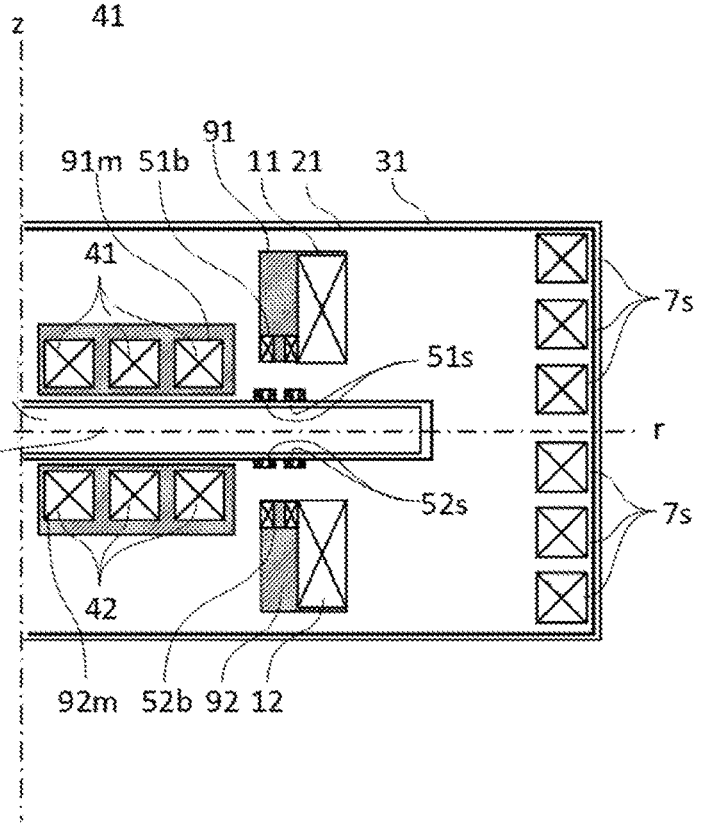
Figure 4C:
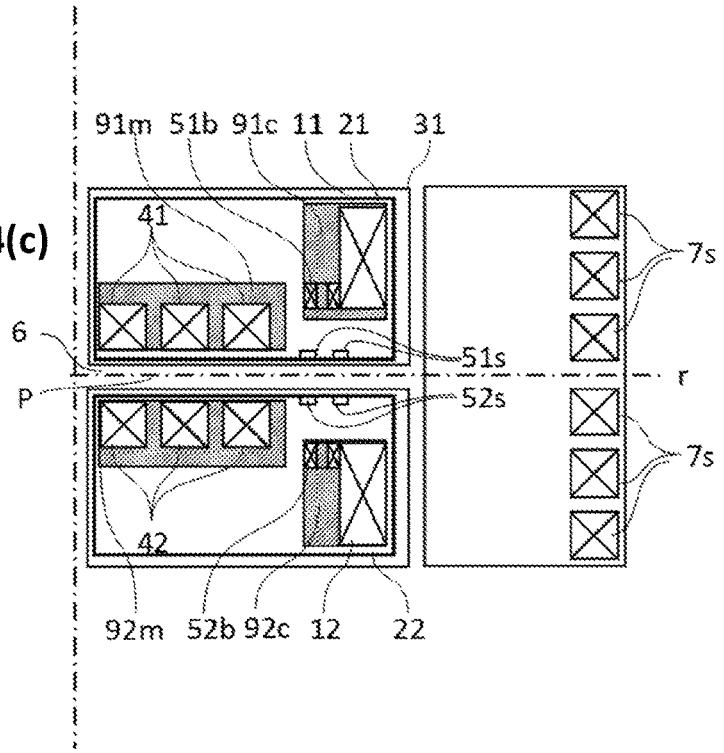
Figure 4D:
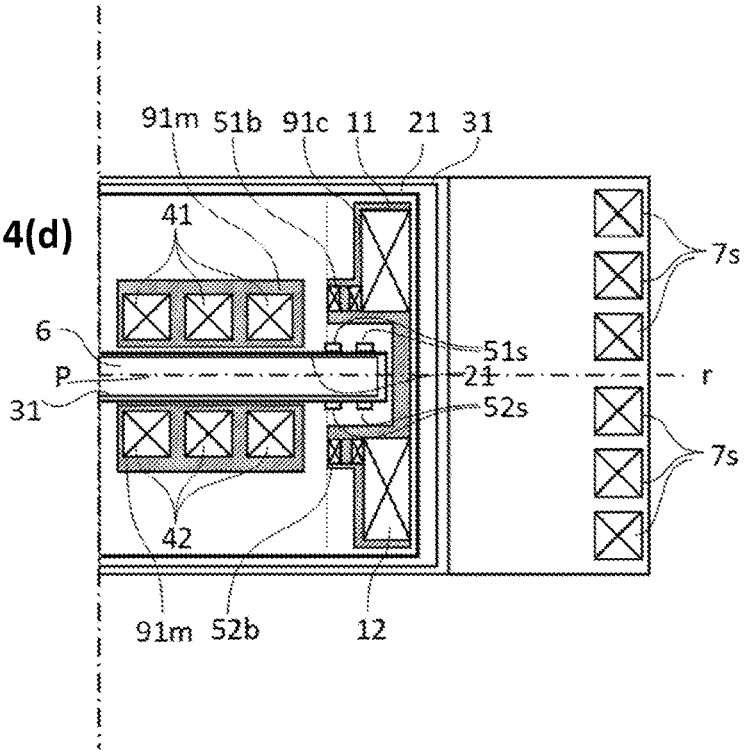
Figure 5A:
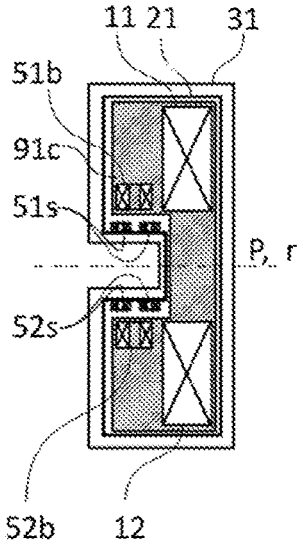
FIG. 5(*a*)-5(*t*) show various arrangements of field bump modules according to the present disclosure.
Figure 5B:
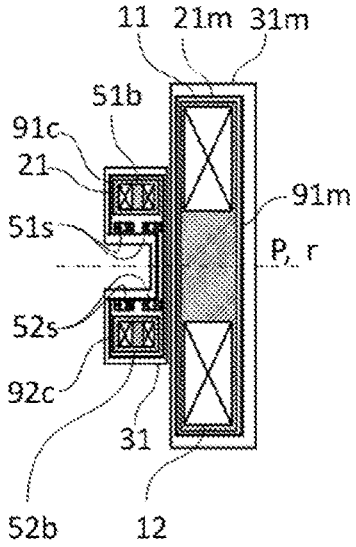
Figure 5C:
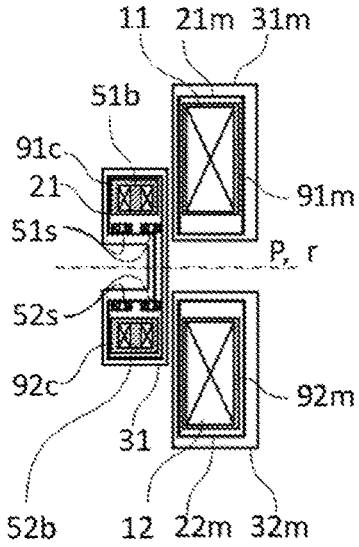
Figure 5D:
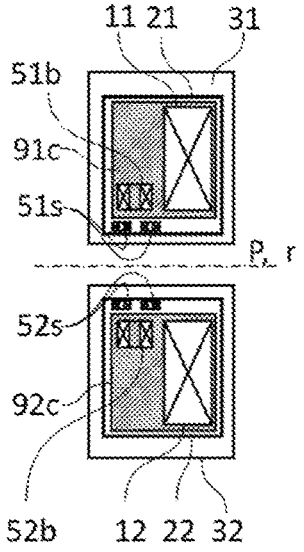
Figure 5E:
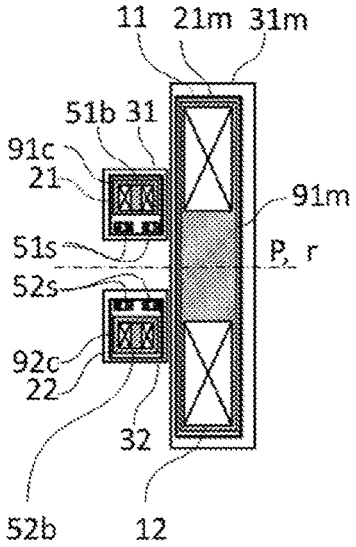
Figure 5F:
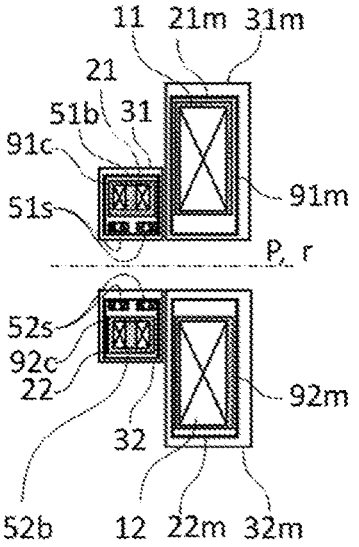

The present disclosure concerns accelerated particle beam extraction systems applied to cyclotrons, including both isochronous cyclotrons and synchrocyclotrons producing beams of charged particles such as hadrons and, in particular, protons having a target energy, Ei. The target energy of the particle beam can be of the order of 15 to 400 MeV/nucleon, for example 60 and 350 MeV/nucleon, or between 70 and 300 MeV/nucleon. As illustrated in FIGS. 2, 3(*a*), and 3(*b*), a cyclotron according to the present disclosure comprises at least a first and second superconducting main coils (11, 12) centered on a common central axis, z, arranged parallel to one another on either side of a median plane, P, normal to the central axis, z, and defining a symmetry plane of the cyclotron. It is possible to use a single superconducting main coil extending across the median plane, P, but at least two superconducting main coils arranged on either side of the median plane are preferred. The first and second superconducting main coils generate a main magnetic field, B, when activated by a source of electric power, The cyclotron also comprises first and second field shaping units (41, 42) arranged within the first and second superconducting main coils on either side of the median plane, P, and separated from one another by an acceleration gap (6). The first and second field shaping units (41, 42) control in the acceleration gap a z-component, Bz, of the main magnetic field, which is parallel to the central axis, z. The z-component, Bz, drives the particles accelerated by the RF-accelerating system along the spiral path followed by the particle beam. A magnetic field characterized by a maximum value of the z-component, Bz, in the accelerating gap of at least 3 T may be produced, with at least 4 T, or 5 T produced in alternate embodiments. When the accelerating particle beam reaches the target energy, Ei, it is extracted from the acceleration gap (6).

Field Bump Modules (51, 52)

In order to extract a beam of accelerated particles of energy Ei, the cyclotron comprises at least a first and second field bump modules (51, 52) arranged on either side of the median plane, P, and extending circumferentially over a common azimuthal angle, φb, for creating, when activated, a local magnetic field bump in the main magnetic field, Bz. Each of the field bump modules comprises at least one superconducting bump coil (51*b*, 52*b*) locally generating a broad magnetic field bump or dip when activated by a source of electric power. The magnetic field bump thus generated has a bell-shape of maximum bump magnitude, ΔBz, and is defined by a first gradient, $(dBz/dr)_1$, of the z-component, Bz, in a radial direction r. The first gradient, $(dBz/dr)_1$, is herein defined as the highest absolute value of the magnetic field gradient measured on a first side of the bell-shaped bump or dip. In other words, it is the steepest slope of the first side of the bump or dip. The perturbation can be a bump or a dip. For sake of conciseness and as is usual in the art, the term "bump" is often used alone, but it is clear that this term encompasses the case of a dip. The first side of the bump is preferably, but not necessarily, the downstream side of the bump, wherein downstream is expressed with respect to the radial direction, r, starting from the center of the cyclotron.

As discussed in the Background section supra, because of their low temperature requirements the superconducting bump coils are positioned at a certain distance from the median plane, P, and the resulting first gradient of a magnetic field bump generated solely by a pair of superconducting bump coils is too low for generating an optimal oscillation of the beam path and an optimal offset of the center of the beam path for the extraction of the particle beam. FIG. 1(*b*) illustrates an example of magnetic field bump generated solely by a pair of superconducting bump coils (51*b*, 52*b*). In FIG. 1(*b*)-(*d*), the first gradient is illustrated as characterizing the upstream portion of the bump, but the first gradient can characterize the downstream portion of the bell-shaped bump instead, wherein upstream and downstream are defined in the radial direction, starting from the centre of the cyclotron.

The present disclosure consists of providing each of the field bump modules with at least one superconducting bump shaping unit (51*s*, 52*s*) positioned such as to locally steepen the first gradient, $(dBz/dr)_1$, produced by the at least one superconducting bump coil. Preferably the first gradient is increased by a factor of at least two, or, in alternative embodiments, at least 2.5 or at least 3, when the at least one superconducting bump shaping unit (51*s*, 52*s*) is activated. Again, the first gradient is defined as the steepest slope of the bump or dip obtained with the superconducting bump shaping unit, regardless of whether or not it is measured at the same radial position along an axis, r, or at the same value of the magnetic field, Bz, as without the superconducting bump shaping unit.

FIGS. 1(*c*) and (*d*) illustrate magnetic field bumps generated by a pair of bump modules (51, 52) according to two embodiments of the present disclosure (only the first bump module (51) is represented in the Figures for sake of clarity). It can be seen that by adequately positioning the superconducting bump shaping units (51*s*, 52*s*), the FWHM of the bumps illustrated in FIGS. 1(*c*) and (*d*) are substantially lower than the FWHM of the broad bump of FIG. 1(*b*) generated absent any superconducting bump shaping unit. The full width at half maximum, FWHM, of a magnetic field bump or dip generated by field bump modules according to the present disclosure can be typically comprised between 15 and 60 mm, or, in alternative embodiments, between 20 and 50 mm, or between 21 and 40 mm. The FWHM value of a broad magnetic field bump generated solely by superconducting bump coils (51*b*, 52*b*) illustrated in FIG. 1(*b*) is typically of the order of 70 mm and more. In other words, the bump is narrower when generated by a pair of bump modules according to the present disclosure than solely by a pair of superconducting bump coils (51*b*, 52*b*). The FWHM can be approximated by: $FWHM \cong 2.35\sigma$, wherein $\sigma$ is the standard deviation of the bell-shaped bump. The magnitude, $\Delta Bz$, of the bump can be of the order of 0.5 to 1.5 T, or, in alternative embodiments, 0.7 to 1.2 T, or 0.8 to 1.0 T.

Table 1 lists the values of sigma, FWHM, and $\Delta Bz$ measured on bumps generated by pairs of field bump modules comprising,

- 51*b*/52*b*: solely superconducting bump coils (51*b*, 52*b*), yielding a broad bump of FWHM of 70.5 mm,
- (51*b*+51*s*)/(52*b*+52*s*) superconducting bump coils (51*b*, 52*b*) and superconducting bump shaping units (51*s*, 52*s*) according to the present disclosure and illustrated in FIGS. 3(*a*), 3(*b*), and 4(*a*)-4(*d*), yielding a narrow bump with FWHM of 23.5 mm similar to the one obtained with
- Steel: Low carbon steel according to the state of the art, e.g., WO2013098089.

TABLE 1

FWHM and ΔBz of bumps generated by various field bump modules

| Field bump module | 51b/52b (SC bump coil only) | (51b + 51s)/ (52b + 52s) (Disclosure) | Steel Prior art |
|---|---|---|---|
| σ | >30 mm | 10 mm | 10 mm |
| FWHM = 2.35 σ | >70.5 mm | 23.5 mm | 23.5 mm |
| ΔBz (Tesla) | 0.95 T | 0.95 T | 0.94 T |

It can be seen in Table 1 that a field bump very similar to the one obtained with steel shims is obtained with field bump modules according to the present disclosure. The physical principle underlying this result is, however, the opposite of iron/steel shimming. While iron shims locally increase the magnetic field, the superconducting shape units (51*s*, 52*s*) of the present disclosure locally reduce the broad magnetic field bump generated by the first and second superconducting bump coils (51*b*, 52*b*), thus shaping the bump to reproduce the shape of a bump produced by iron shims, with the additional advantage, that the magnitude and FWHM can be controlled and varied easily. This explains the use of the term "shaping" rather than "shimming" for designating the superconducting shaping units (51*s*, 52*s*). The use of superconducting shaping units can also be envisaged at the start of the extraction channel.

The resulting slopes of the narrower bumps generated with the present disclosure are substantially steeper with higher values of the first gradient. For example, a first gradient, $(dBz/dr)_1$, in a radial direction of a bump generated with bump modules according to the present disclosure as illustrated in FIGS. 1(*c*) and (*d*) can have a maximal absolute value of at least 40 T/m, or, in alternative embodiments, at least 60 T/m, at least 70 T/m, or at least 80 T/m. These are slope values comparable with values obtainable by using conventional iron shims such as described in U.S. Pat. No. 8,581,525 or WO2013098089 (cf. Table 1), corresponding to perturbations able to generate an oscillation of the accelerated particles which shifts the center of the successive orbits by an offset, $\Delta y$, and eventually leads the particle beam out of the cyclotron as illustrated in FIG. 2 (not to scale). Absent superconducting bump shaping units, the corresponding maximal first gradient of a broad bump generated with bump modules comprising solely a pair of superconducting bump coils could be of the order of 20 T/m, which is sub-optimal for creating the kind of oscillations required for extracting a beam of accelerated particles.

In one embodiment illustrated in FIG. 1(*c*), the at least one superconducting bump shaping unit (51*s*, 52*s*) of each field bump module can be a passive bulk superconductor, activated by the applied main magnetic field, B, and/or by the broad magnetic field bump. A passive bulk superconductor is a bulk piece of superconducting material, which is not connected to any source of electric power. Bulk superconducting materials can be machined to a specific geometry.

Alternatively (or additionally) the superconducting bump shaping units may comprise a superconducting shaping coil activated by a source of electric power, as illustrated in FIG. 1(*d*). Like the superconducting bump coils, the superconducting shaping units (51*s*, 52*s*) can be in the form of one or more superconducting shaping coils formed by coiled threads, wires, ribbons, tapes, etc. A passive bulk superconductor is easier to install as it requires no connection to a source of power. The shape and magnitude of the bump, however, can only be controlled by controlling the current in the superconducting bump coils (51*b*, 52*b*). Using superconducting shaping coils allows an easy control of the shape and magnitude of the bump by varying the current in both superconducting bump coils (51*b*, 52*b*) and superconducting shaping coils (51*s*, 52*s*). This may be advantageous for maintaining a linearity between the bump and the z-component, Bz, of the main magnetic field. In all cases, and in particular for synchrocyclotrons, a ratio of the maximum bump magnitude to the z-component, ΔBz/Bz, remains substantially constant for cycles of injection, acceleration, and extraction of charged particles at different extracted energies.

The superconducting bump coils (51*b*, 52*b*) of the first and second field bump modules (51, 52) are generally made of low temperature superconductors (LTS), such as one or more superconducting materials from the Nb-family (e.g., NbTi, $Nb_3Sn$, $Nb_3Al$), or $MgB_2$. A LTS can be superconducting at a temperature, T2, of generally at least 2 K, or, in alternative embodiments, generally at most 10 K and of the order of 4 K±1 K.

The superconducting bump shaping units (51*s*, 52*s*) of the first and second field bump modules (51, 52) can typically be made of a high temperature superconductor (HTS), such as one or more superconducting materials from the cuprate family (e.g., bismuth strontium calcium copper oxide (BSSCO), rare-earth barium copper oxide (REBCO) such as yttrium barium copper oxide (YBCO)), the iron-based family (e.g., iron-lanthanide family, iron-arsenide family, FeSe family), or $MgB_2$. A HTS can be superconducting at a temperature, T1, of generally at least 20 K and generally at most 75 K. The first and second field bump modules according to the present disclosure do not require, and preferably do not comprise any non-superconducting iron components, nor any permanent magnet components other than superconductors.

The superconducting bump shaping units are used to modify the shape of the bump, by narrowing it and by steepening the slopes of the bell-shaped broad bump, while keeping the magnitude, ΔBz, of the bump relatively constant. The use of passive or active shims for correcting a magnetic field is known as the process of "shimming." While shimming, however, is known for homogenizing a main magnetic field, Bz, in particular in magnetic resonance imaging (MRI) apparatuses, the superconducting bump shaping units (51*s*, 52*s*) of the present disclosure have the opposite goal of sharpening the perturbation generated by the superconducting bump coils (51*b*, 52*b*).

The first and second field bump modules (51, 52) extend circumferentially only over a given azimuthal angle, φb, for example between 15° and 40°, or between 25 and 35°.

The bell-shaped bump is defined by an upstream slope and a downstream slope (in the radial direction), one of which is characterized by a first gradient, $(dBz/dr)_1$, and the other is characterized by a second gradient, $(dBz/dr)_2$, of the z-component, Bz, in the radial direction, which is of opposite sign to the first gradient, $(dBz/dr)_1$. The second gradient, $(dBz/dr)_1$, is herein defined as the highest absolute value of the magnetic field gradient measured on a second side of the bell-shaped bump or dip. In an embodiment, the first and second field bump modules each comprises at least a second superconducting bump shaping unit (51*s*, 52*s*) positioned such as to locally steepen in the radial direction the second gradient, $(dBz/dr)_2$, produced by the at least one superconducting bump coil. The maximal absolute value of the second gradient, $(dBz/dr)_2$, is at least 40 T/m, or, in alternative embodiments, at least 60 T/m, at least 70 T/m, and at least 80 T/m.

In order to steepen both upstream and downstream slopes of the bell-shaped bump, each of the at least first and second field bump modules (51, 52) may be defined as follows: in a projection onto the median plane, each field bump module comprises,

- one or more upstream superconducting bump shaping units (51*s*, 52*s*) for steepening the upstream slope,
- one or more superconducting bump coils (51*b*, 52*b*) for generating the broad magnetic field bump or dip, and
- one or more downstream superconducting bump shaping unit (51*s*, 52*s*) for steepening the downstream slope, arranged sequentially in a radial direction starting from the central axis, z, and confined within a given azimuthal sector of angle φb. As illustrated in FIGS. 1(*c*) and (*d*), 3(*a*), 3(*b*), 4(*a*)-4(*d*), and 5, the one or more upstream and downstream superconducting bump shaping units (51*s*, 52*s*) are not necessarily at the same distance from the median plane, P, as the one or more superconducting bump coils (51*b*, 52*b*). The upstream and downstream superconducting bump shaping units (51*s*, 52*s*) may be located closer to the median plane than the superconducting bump coils (51*b*, 52*b*). The projections of the upstream and downstream superconducting bump shaping units (51*s*, 52*s*) onto the median plane can therefore overlap with the projection of the superconducting bump coils (51*b*, 52*b*), as illustrated in FIGS. 3(*a*) and 4(*a*).

Cyclotron

The present disclosure concerns superconducting isochronous cyclotrons and synchrocyclotrons alike. It is advantageous because the magnitude of the bump can be varied independently of the magnitude of the z-component of the main magnetic field, Bz. When the superconducting main coils (11, 12) generate the main magnetic field, B, the z-component thereof in the acceleration gap (6) is controlled by a first and second field shaping units (41, 42).

The field shaping units (41, 42) can be first and second magnet poles made of a magnetic material as illustrated in FIGS. 3(*a*) and 3(*b*). Cyclotrons comprising first and second magnet poles are well known in the art. Examples of conventional synchrocyclotrons are described in WO2013098089 and WO2012055 WO2012055890, and an example of a conventional isochronous cyclotron is described in WO2012004225. In isochronous cyclotrons, magnet poles generally form hill sectors separated by valley sectors alternatively distributed about the central axis, to focus the beam of charged particles.

Alternatively, or in combination with magnet poles, the field shaping units (41, 42) can comprise field shaping coils, such as superconducting coils generating a shaping magnetic field when activated by a source of electric power, as illustrated in FIGS. 4(*a*)-4(*d*). WO2014018876 describes field shaping with both synchrocyclotrons and isochronous cyclotrons, and WO2013/113913 described field shaping with isochronous cyclotrons.

The same applies for flux returns (7), which can be made of bulk magnetic material as illustrated in FIG. 3, or may comprise coils, preferably superconducting coils (7*s*) as illustrated in FIG. 4. The present disclosure can be applied to any of the foregoing types of cyclotrons.

Arrangements of the Field Bump Modules (51, 52)

Vacuum Chamber

FIGS. 5(*a*)-5(*f*) illustrate various arrangements of field bump modules (51, 52). The superconducting components of each field bump module must be enclosed in a vacuum chamber (31, 32). As shown in FIGS. 5(*a*)-5(*c*), a single vacuum chamber may extend across the median plane, P, and contain the first and second field bump modules. The single vacuum chamber may also enclose the first and second superconducting main coils (cf. FIG. 5(*a*)), and may also enclose the superconducting field shaping coils (41, 42) as illustrated in FIG. 4(*d*) and/or the superconducting flux return coils (7*s*) as shown in FIG. 4(*b*). Alternatively, the single vacuum chamber (31) may comprise solely the first and second field bump modules. In this embodiment, the main superconducting coils (11, 12) and any other superconducting coils of the cyclotron are lodged in one or more separate vacuum chambers (31*m*, 32*m*), as illustrated in FIGS. 5(*b*) and (*c*). Pressures of the order of below $10^{-3}$ mbar are required in the vacuum chamber.

In an alternative embodiment illustrated in FIGS. 5(*d*)-5(*f*), the first field bump module (51) is enclosed in a first vacuum chamber (31) located at one side of the median plane, P, and the second field bump module (52) is enclosed in a second vacuum chamber (32) located on the other side of the median plane, P. The first and second superconducting main coils (11, 12) and, optionally any other superconducting coil of the cyclotron may be enclosed in the first and second vacuum chambers, respectively, as shown in FIG. 5(*d*). Alternatively, the first and second superconducting main coils are enclosed in a single vacuum chamber (31*m*) separated from the first and second vacuum chambers (31, 32), as shown in FIG. 5(*e*), or in two separate vacuum chambers (31*m*, 32*m*) as shown in FIG. 5(*f*).

Radiation Shield

The cyclotron of the present disclosure may comprise at least a first radiation shield (21) enclosed in the first vacuum chamber (31), and containing at least the first field bump module. A radiation shield is used to thermally insulate the superconducting elements contained therein from heat transfer by radiation. Heat shields are usually made of aluminium or copper sheets lined with a multilayer insulation (MLI) and are well known to persons of ordinary skill in the art.

In the embodiments comprising a single vacuum chamber (31) described supra, a single radiation shield (21) extending across the median plane, P, may enclose both field bump modules (51, 52), as shown in FIGS. 5(*a*)-5(*c*). Alternatively, the first radiation shield (21) may enclose the first field bump module (51) and a second radiation shield (22) located symmetrically with respect to the median plane, P, may enclose the second field bump module (52). Other superconducting elements may be enclosed in the one or two radiation shields, including the first and second superconducting main coils (11, 12) (cf. FIG. 5(*a*)) and optionally superconducting field shaping coils (41, 42).

In the embodiments comprising first and second vacuum chambers (31, 32), a first and second radiation shields (21, 22) are enclosed in the respective first and second vacuum chambers, as illustrated in FIGS. 5(*d*)-5(*f*). The first and second radiation shields (21, 22) enclose the first and second field bump modules (51, 52). They may enclose the first and second superconducting main coils (11, 12) too, as well as any other superconducting element of the cyclotron. Alternatively, the first and second superconducting main coils (11, 12) and any other superconducting element of the cyclotron may be contained in one or more radiation shields (31*m*, 32*m*) of their own and be part of a cold mass structure (91*m*, 92*m*) of their own, as shown in FIGS. 5(*b*), (*c*), (*e*), and (*f*).

Cryocoolers (81, 82)

In order to bring the superconducting elements (51*b*, 51*s*, 52*b*, 52*s*) below their respective critical temperatures, the field bump modules (51, 52) are thermally coupled to one or more cryocoolers (81, 82). As discussed supra, the superconducting bump coils (51*b*, 52*b*) may be made of a low temperature superconductor (LTS) which must be cooled to a temperature T2 of less than 10 K close to liquid helium temperature, while the superconducting shaping coils (51*s*, 52*s*) may be made of a high temperature superconductor (HTS) which can be cooled to a temperature T1>T2 of the order of 30 to 75 K, close to liquid nitrogen temperature. For this reason, each of the one or more cryocoolers may comprise a first stage (81*w*, 82*w*), suitable for cooling a structure to the first mean temperature, T1, and a second stage (81*c*, 82*c*) suitable for cooling a structure to the second mean temperature, T2, with T2<T1.

As illustrated in FIG. 3(*b*), the first stage (81*w*, 82*w*) of each cryocooler may be thermally coupled to the corresponding radiation shields (21, 22), for cooling said radiation shields to the first mean temperature, T1. In this embodiment, the first and second HTS-superconducting bump shaping units (51*s*, 52*s*) are in thermal contact with the thus cooled corresponding radiation shield (21, 22) and therefore maintained at the first mean temperature, T1, where the bump shaping units have superconducting properties.

The second stage (81*c*, 82*c*) of each cryocooler may be thermally coupled to a cold mass structure (91*c*, 92*c*) located inside the corresponding radiation shields (21, 22), and including the LTS-superconducting bump coils (51*b*, 52*b*). The cold mass structure can thus be cooled to the second mean temperature, T2. The cyclotron may comprise a single cold mass structure (91*c*) including first and second LTS-superconducting bump coils (51*b*, 52*b*), as illustrated in FIG. 5(*a*). In this embodiment, a single cryocooler (81) suffices to cool a single cold mass structure. Alternatively, several cryocoolers can be used to increase the cooling capacity. In alternative embodiments, the first LTS-superconducting bump coil (51*b*) belongs to the first cold mass structure (91*c*) in thermal contact with the second stage of the first cryocooler (81), and the second LTS-superconducting bump coil (52*b*) belongs to a second cold mass structure (92*c*) in thermal contact with the second stage of a second cryocooler (82), as shown in FIG. 3(*b*). The one or more cold mass structures may further include the superconducting main coils (11, 12), and/or the superconducting field shaping units (41, 42), To summarize, a cyclotron according to the present disclosure is provided with a first vacuum unit comprising:

- a first vacuum chamber (31),
- a first radiation shield (21) contained in the first vacuum chamber (31),
- a first cold mass structure (91*c*) located inside the first radiation shield (21), and including the superconducting bump coil (51*b*) of at least the first field bump module (51), and optionally further including:
  - at least the first superconducting main coil (11), and/or
  - at least the first superconducting field shaping unit (41),
- at least a first cryocooler (81) comprising:
- a first stage (81*w*) coupled to the first radiation shield (21), for cooling the first radiation shield at a first mean temperature, T1, with the superconducting bump shaping unit (51*s*) of at least the first field bump module (51), being in thermal contact with the first radiation shield (21) and at the first mean temperature, T1, and a second stage (81*c*) coupled to the first cold mass structure for cooling the first cold mass structure to a second mean temperature T2 lower than T1, (T2<T1), In the embodiment illustrated in FIGS. 5(*a*)-5(*c*), wherein the first vacuum chamber (31) extends over the median plane, P, the first radiation shield (21) may either (A) extend over the median plane, P, or (B) be located at one side of the median plane.

If the first radiation shield (21) extends over the median plane, P, it may further contain:

the superconducting bump coil (52*b*) of the second field bump module (52), which is included in the first cold mass structure (91*c*) or is included in the second cold mass structure (92*c*) coupled to the second stage (81*c*, 82*c*) of the first or second cryocooler (81, 82) for cooling the second cold mass structure at the second mean temperature, T2, the superconducting bump shaping unit (52*s*) of the second field bump module (52) is in thermal contact with the first radiation shield (21) for cooling to the first mean temperature, T1, optionally the second superconducting main coil (12), and/or the second superconducting field shaping unit (42), can belong to the first cold mass structure or to the second cold mass structure (92*c*) maintained at the second mean temperature, T2, by the second stage of the first or the second cryocooler, or If the first radiation shield (21) is located at one side of the median plane, the cyclotron may further comprise:

a second radiation shield (22) located symmetrically of the first radiation shield (21) with respect to the median plane, P, the second radiation shield enclosing a second cold mass structure (92*c*) including the superconducting bump coil (52*b*) of the second field bump module (52), and optionally further including:

the second superconducting main coil (12), and/or the second superconducting field shaping unit (42), at least one cryocooler (81, 82) which can be the same as or different from the cryocooler coupled to the first radiation shield (21), which comprises:

a first stage (81*w*, 82*w*) coupled to the second radiation shield (22), for cooling the second radiation shield to the first mean temperature, T1, with the superconducting bump shaping unit (52*s*) of the second field bump module (52), being in thermal contact with the second radiation shield (22) and at the first mean temperature, T1, and a second stage (82*c*) coupled to the second cold mass structure for cooling said second cold mass structure to the second mean temperature T2, In the embodiment illustrated in FIGS. 5(*d*)-5(*f*), wherein the first vacuum unit is located at one side of the median plane, P, and wherein the cyclotron comprises a second vacuum unit, which is symmetrically identical to the first vacuum unit with respect to the median plane, P, said second vacuum unit comprises:

a second vacuum chamber (32), a second radiation shield (22) contained in the second vacuum chamber (32), a second cold mass structure (92*c*) located inside the second radiation shield (22), and including the superconducting bump coil (52*b*) of the second field bump module (52), and optionally further including:

the second superconducting main coil (12), and/or the second superconducting field shaping unit (42), at least a second cryocooler (82) comprising:

a first stage (82*w*) coupled to the second radiation shield (22), for cooling the second radiation shield at the first mean temperature, T1, with the superconducting bump shaping unit (52*s*) of the second field bump module (52), being in thermal contact with the second radiation shield (22) and at the first mean temperature, T1, and a second stage (82*c*) coupled to the second cold mass structure for cooling the second cold mass structure to the second mean temperature T2.

One advantage of using HTS materials for the superconducting field shaping units (51*s*, 52*s*) is that they can be located in direct contact with the radiation shield walls, and thus substantially closer to the acceleration gap (6) than the LTS-superconducting bump coils (51*b*, 52*b*) which must be maintained at a lower temperature, T2, and are physically located further away from the acceleration gap. Shaping of the broad bump generated by the LTS-superconducting bump coils (51*b*, 52*b*) can therefore be more accurate.

In an embodiment of the present disclosure, a ratio of a maximum magnetic field bump magnitude to the z-component of the main magnetic field, $\Delta Bz/Bz$, remains substantially constant for cycles of injection, acceleration, and extraction of charged particles at different extracted energies.

The at least one superconducting bump shaping unit may comprise at least one of:

a passive bulk superconductor, activated by at least one of the applied main magnetic field, B, or the broad magnetic field bump or dip; or a superconducting shaping coil activated by a source of electric power.

To keep the superconducting elements of the cyclotron in a vacuum and below their respective critical temperatures, the cyclotron may comprise a first vacuum unit comprising:

a first vacuum chamber;

a first radiation shield contained in said first vacuum chamber;

a first cold mass structure located inside the first radiation shield, and including the superconducting bump coil of at least the first field bump module; and a first cryocooler comprising a first stage coupled to the first radiation shield for cooling said first radiation shield at a first mean temperature, T1, and a second stage coupled to the first cold mass structure for cooling said first cold mass structure to a second mean temperature T2 lower than T1, wherein the superconducting bump shaping unit of at least the first field bump module is in thermal contact with the first radiation shield and at the first mean temperature, T1.

Various arrangements can be envisaged comprising the foregoing elements. In a first embodiment, the first vacuum chamber extends over the median plane, P, and either, the first radiation shield extends over the median plane, P, and further contains:

the superconducting bump coil of the second field bump module, which is included in the first cold mass structure or is included in a second cold mass structure coupled to the second stage of the first or of a second cryocooler for cooling said second cold mass structure at the second mean temperature, T2; and the superconducting bump shaping unit of the second field bump module is in thermal contact with the first radiation shield and at the first mean temperature, T1;

or:

the first radiation shield is located at one side of the median plane and the cyclotron further comprises:

a second radiation shield located symmetrically of the first radiation shield with respect to the median plane, P, said second radiation shield enclosing a second cold mass structure including the superconducting bump coil of the second field bump module; and at least one cryocooler, comprising:

a first stage coupled to the second radiation shield, for cooling said second radiation shield to the first mean temperature, T1; and a second stage coupled to the second cold mass structure for cooling said second cold mass structure to the second mean temperature T2;

wherein the superconducting bump shaping unit of the second field bump module is in thermal contact with said second radiation shield and at said first mean temperature, T1.

In an alternative embodiment, the first vacuum unit wherein the first vacuum unit is located at one side of the median plane, P, and wherein the cyclotron further comprises:

a second vacuum unit, which is symmetrically identical to the first vacuum unit with respect to the median plane, P, said second vacuum unit comprising:

a second vacuum chamber, a second radiation shield contained in said second vacuum chamber, a second cold mass structure located inside the second radiation shield, and including the superconducting bump coil of the second field bump module; and at least a second cryocooler comprising:

a first stage coupled to the second radiation shield, for cooling said second radiation shield at the first mean temperature, T1; and a second stage coupled to the second cold mass structure for cooling said second cold mass structure to the second mean temperature T2;

wherein the superconducting bump shaping unit of the second field bump module is in thermal contact with the second radiation shield and at the first mean temperature, T1.

In an embodiment of the present disclosure, the at least one superconducting bump coil of the first and second field bump modules are made of low temperature superconductors and, in use, are maintained at the temperature, T2, between 2 and 10 K; and the first and second superconducting bump shaping units of the first and second field bump modules are made of a high temperature superconductor and, in use, are maintained at the temperature, T1, between 30 and 75 K, and are located closer to the median plane than the corresponding first and second superconducting bump coils. A controller can be configured to ensure that, in use, the HTS and LTS elements are maintained within the foregoing temperature ranges. Neither the first, nor the second field bump module preferably comprises no non-superconducting iron components and no permanent magnet components other than superconductors.

For example, the at least one superconducting bump coil of the first and second field bump modules can be formed by coiled wires or tapes made of one or more materials selected from e.g., the Nb-family, or $MgB_2$. The at least one superconducting bump shaping unit of the first and second field bump modules may comprise a superconducting material selected from one or more materials from the cuprate family, the iron-based family, or $MgB_2$.

A controller can also be configured to ensure that the first and second field bump modules create a first gradient, $(dBz/dr)_1$, in the radial direction of maximal absolute value of at least 40 T/m.

The bell-shaped broad magnetic field bump or dip has an upstream slope and a downstream slope (expressed with respect to the radial direction, starting from the center of the cyclotron). The first gradient, $(dBz/dr)_1$, characterizes one of the upstream or downstream slopes (preferably the downstream slope) and a second gradient, $(dBz/dr)_2$, of the z-component, Bz, in the radial direction of opposite sign to the first gradient, $(dBz/dr)_1$, characterizes the other one of the upstream or downstream slopes (preferably the upstream slope).

In an embodiment, the first and second field bump modules each comprises at least a second superconducting bump shaping unit positioned such as to locally steepen in the radial direction the second gradient, (dBz/dr)2, produced by the at least one superconducting bump coil by a factor of at least two.

For shaping the slopes of the broad magnetic field bump or dip with first and second gradients, (dBz/dz), each of the at least first and second field bump modules (51, 52) is defined comprises, in a projection onto the median plane, one or more upstream superconducting bump shaping units for steepening the first gradient (dBz/dr)1;

one or more superconducting bump coils for generating the broad magnetic field bump or dip; and one or more downstream superconducting bump shaping units for steepening the second gradient (dBz/dr)2;

wherein the one or more superconducting bump shaping units and one or more superconducting bump coils are arranged sequentially in a radial direction starting from the central axis, z, and confined within a given azimuthal sector.

The magnetic field bump or dip is preferably shaped such that the FWHM of the bell-shaped magnetic field bump or dip is between 15 and 60 mm.

Each of the first and second field shaping units can be formed by:

a magnet pole made of a magnetic material, or one or more field shaping coils, preferably superconducting field shaping coils, generating a shaping magnetic field when activated by a source of electric power, or a combination of the two.

The same applies to the flux returns, which can be in the form of a yoke, or of coils, which may or may not be superconducting coils.

The invention claimed is:

1. A cyclotron for accelerating charged particles comprising:

at least a first superconducting main coil and second superconducting main coil centered on a common central axis, (z), arranged parallel to one another on either side of a median plane, (P), normal to the central axis, (z), and defining a symmetry plane of the cyclotron, said at least first and second superconducting main coils generating a main magnetic field, (B), when activated by a source of electric power;

a first field shaping unit and second field shaping unit arranged within the first and second superconducting main coils on either side of the median plane, (P), and separated from one another by an acceleration gap, said first and second field shaping units being suitable for controlling in the acceleration gap a z-component, (Bz), of the main magnetic field, which is parallel to the central axis, (z);

at least a first field bump module and second field bump module arranged on either side of the median plane, (P), and extending circumferentially over a common azimuthal angle, (φb), for creating, when activated, a local magnetic field bump in the z-component, (Bz), of the main magnetic field, wherein each of the field bump modules comprises:

at least one superconducting bump coil locally generating a broad magnetic field bump or dip when activated by a source of electric power, said magnetic field bump having a bell-shape of maximum bump magnitude, (ΔBz), and being defined by a first gradient, $(dBz/dr)_1$, of the z-component, (Bz), in a radial direction, (r); and at least one superconducting bump shaping unit positioned such as to locally steepen the first gradient, $(dBz/dr)_1$, produced by the at least one superconducting bump coil, when said at least one superconducting bump shaping unit is activated.

2. The cyclotron according to claim 1, wherein a ratio of a maximum magnetic field bump magnitude to the z-component of the main magnetic field, (ΔBz/Bz), remains substantially constant for cycles of injection, acceleration, and extraction of charged particles at different extracted energies.

3. The cyclotron according to claim 1, wherein the at least one superconducting bump shaping unit further comprises at least one of:

a passive bulk superconductor, activated by at least one of the applied main magnetic field, (B), or the broad magnetic field bump or dip; or a superconducting shaping coil activated by a source of electric power.

4. The cyclotron according to claim 1, further comprising a first vacuum unit including:

a first vacuum chamber;

a first radiation shield contained in said first vacuum chamber;

a first cold mass structure located inside the first radiation shield, and including the superconducting bump coil of at least the first field bump module; and a first cryocooler comprising a first stage coupled to the first radiation shield for cooling said first radiation shield at a first mean temperature, (T1), and a second stage coupled to the first cold mass structure for cooling said first cold mass structure to a second mean temperature (T2) lower than (T1), wherein the superconducting bump shaping unit of at least the first field bump module is in thermal contact with the first radiation shield and at the first mean temperature, (T1).

5. The cyclotron according to claim 4, wherein the first vacuum chamber extends over the median plane, (P); and the first radiation shield extends over the median plane, (P), and further contains:

the superconducting bump coil of the second field bump module, which is included in the first cold mass structure or is included in a second cold mass structure coupled to the second stage of the first or of a second cryocooler for cooling said second cold mass structure at the second mean temperature, (T2); and the superconducting bump shaping unit of the second field bump module is in thermal contact with the first radiation shield and at the first mean temperature, (T1).

6. The cyclotron according to claim 4, wherein the first radiation shield is located at one side of the median plane and the cyclotron further comprises:

a second radiation shield located symmetrically of the first radiation shield with respect to the median plane, (P), said second radiation shield enclosing a second cold mass structure including the superconducting bump coil of the second field bump module; and at least one cryocooler, comprising:

a first stage, coupled to the second radiation shield, for cooling said second radiation shield to the first mean temperature, (T1); and a second stage coupled to the second cold mass structure for cooling said second cold mass structure to the second mean temperature (T2);

wherein the superconducting bump shaping unit of the second field bump module is in thermal contact with said second radiation shield and at said first mean temperature, (T1).

7. The cyclotron according to claim 4, wherein the first vacuum unit is located at one side of the median plane, (P), and wherein the cyclotron further comprises:

a second vacuum unit, which is symmetrically identical to the first vacuum unit with respect to the median plane, (P), said second vacuum unit comprising:

a second vacuum chamber;

a second radiation shield contained in said second vacuum chamber;

a second cold mass structure located inside the second radiation shield, and including the superconducting bump coil of the second field bump module; and at least a second cryocooler comprising:

a first stage coupled to the second radiation shield, for cooling said second radiation shield at the first mean temperature, (T1); and a second stage coupled to the second cold mass structure for cooling said second cold mass structure to the second mean temperature (T2);

wherein the superconducting bump shaping unit of the second field bump module is in thermal contact with the second radiation shield and at the first mean temperature, (T1).

8. The cyclotron according to claim 1, wherein, the at least one superconducting bump coil of the first and second field bump modules are made of low temperature superconductors and, in use, are maintained at the temperature, (T2), between 2 and 10 K; and the first and second superconducting bump shaping units of the first and second field bump modules are made of a high temperature superconductor and, in use, are maintained at the temperature, (T1), between 30 and 75 K, and are located closer to the median plane than the corresponding first and second superconducting bump coils.

9. The cyclotron according to claim 1, wherein the first and second field bump modules create the first gradient, $(dBz/dr)_1$, in the radial direction of maximal absolute value of at least 40 T/m.

10. The cyclotron according to claim 1, wherein the broad magnetic field bump or dip is defined by a second gradient, $(dBz/dr)_2$, of the z-component, (Bz), in the radial direction of opposite sign to the first gradient, $(dBz/dr)_1$, and the first and second field bump modules each comprises at least a second superconducting bump shaping unit positioned such as to locally steepen in the radial direction the second gradient, $(dBz/dr)_2$, produced by the at least one superconducting bump coil, by a factor of at least two.

11. The cyclotron according to claim 10, wherein each of the at least first and second field bump modules comprises, in a projection onto the median plane, one or more upstream superconducting bump shaping units for steepening the first gradient $(dBz/dr)_1$;

one or more superconducting bump coils for generating the broad magnetic field bump or dip; and one or more downstream superconducting bump shaping units for steepening the second gradient $(dBz/dr)_2$;

wherein the one or more superconducting bump shaping units and one or more superconducting bump coils are arranged sequentially in a radial direction starting from the central axis, (z), and confined within a given azimuthal sector.

12. The cyclotron according to claim 1, wherein a full width at half maximum of the magnetic field bump or dip is between 15 and 60 mm.

13. The cyclotron according to claim 1, wherein the first and second field bump modules comprise neither non-superconducting iron components nor permanent magnet components other than superconductors.

14. The cyclotron according to claim 1, wherein, the at least one superconducting bump coil of the first and second field bump modules is formed by coiled wires or tapes made of one or more materials selected from the Nb-family, or $MgB_2$.

15. The cyclotron according to claim 1, wherein, the at least one superconducting bump shaping unit of the first and second field bump modules comprise superconducting material selected from one or more materials from the cuprate family, the iron-based family, or $MgB_2$.

16. The cyclotron according to claim 1, wherein the cyclotron is a synchro-cyclotron or an isochronous cyclotron.

17. The cyclotron according to claim 1, wherein each of the first and second field shaping units is formed by at least one of:

a magnet pole made of a magnetic material; or one or more field shaping coils, generating a shaping magnetic field when activated by a source of electric power.

* * * * *